US006918971B2

(12) United States Patent
Fujii et al.

(10) Patent No.: US 6,918,971 B2
(45) Date of Patent: Jul. 19, 2005

(54) TITANIUM SHEET, PLATE, BAR OR WIRE HAVING HIGH DUCTILITY AND LOW MATERIAL ANISOTROPY AND METHOD OF PRODUCING THE SAME

(75) Inventors: Hideki Fujii, Futtsu (JP); Isamu Takayama, Hikari (JP); Yoshito Yamashita, Tokyo (JP); Mitsuo Ishii, Tokyo (JP); Kazuhiro Takahashi, Hikari (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/226,968

(22) Filed: Aug. 22, 2002

(65) Prior Publication Data

US 2004/0035503 A1 Feb. 26, 2004

(51) Int. Cl.[7] ..... C22C 14/00

(52) U.S. Cl. ..... 148/421; 420/417; 420/418; 420/419; 420/420; 420/421

(58) Field of Search ..... 148/421; 420/417–421

(56) References Cited

U.S. PATENT DOCUMENTS 6,063,211 A * 5/2000 Soeda et al. ..... 148/421

FOREIGN PATENT DOCUMENTS

| | | |
|---|---|---|
| JP | 1-252747 | * 10/1989 |
| JP | 7-268516 | * 10/1995 |
| JP | 2002-180166 | * 6/2002 |
| JP | 2002-294372 | * 10/2002 |

* cited by examiner

*Primary Examiner*—John P. Sheehan
(74) *Attorney, Agent, or Firm*—Kenyon & Kenyon

(57) ABSTRACT

A sheet, a plate, a bar or wire is made of Ti and has high ductility and low material anistropy in a plane of a sheet or plate, or in a sectional plane of a bar or a wire and contains Fe, in mass, at 0.15–0.5%, N at 0.015–0.041 and 0, with the balance Ti and unavoidable impurities. When the Fe content is defined as [Fe], the N content as [N] and the 0 content as [0], the oxygen equivalent value $$Q=[0]+2.77[N]+0.1\,[Fe] \text{ is } 0.11–0.28.$$

4 Claims, No Drawings

TITANIUM SHEET, PLATE, BAR OR WIRE HAVING HIGH DUCTILITY AND LOW MATERIAL ANISOTROPY AND METHOD OF PRODUCING THE SAME

BACKGROUND OF THE INVENTION

1. Field of the Invention

The present invention relates to a sheet, a plate, a bar or a wire which is made of titanium and has high ductility and low material anisotropy, and to a method of producing the same, and, in particular, to a hot-rolled or cold-rolled sheet, a hot-rolled or cold-rolled plate, a hot-rolled or cold-rolled bar, or a hot-rolled or cold-rolled wire, which cold-rolled bar or wire includes that subjected to drawing, each of which is made of commercially pure titanium which is classified as the second or third category in JIS (JIS class 2 or 3), or low-alloyed titanium where a small amount of Fe is added, and a method of producing the same.

2. Description of the Related Art

Titanium has the properties of low weight, high strength, high corrosion resistance and the like, and has been used in the fields of aviation, chemistry, maritime engineering, electric power generation, etc. in which these properties have been required.

Titanium is classified into two categories, namely alloyed titanium and commercially pure titanium. of the two, commercially pure titanium has the properties of medium strength, excellent corrosion resistance, relatively excellent workability and relatively good weldability, and it has been used for producing various shapes of products including a heavy or medium plate, a hot-rolled or cold-rolled strip, a sheet or a plate cut out therefrom, a welded pipe produced by forming and welding a sheet, a large diameter straight round bar, a rectangular straight bar, a bar or wire coil, a medium-to-small diameter bar or wire cut out therefrom, a seamless tube formed by hot extrusion, and the like.

A sheet or a plate, a bar or a wire made of commercially pure titanium is classified into any one of the first to fourth categories under JIS (JIS class 1 to 4) based on added elements and strength, and, in case of JIS class 2 which is most commonly employed, it is specified that the oxygen content is 0.20 mass % or less, the nitrogen content is 0.05 mass % or less and the Fe content is 0.25 mass % or less. In case of JIS class 3 which represents higher strength than JIS class 2, it is specified that the oxygen content is 0.30 mass % or less, the nitrogen content is 0.07 mass % or less and the Fe content is 0.30 mass % or less. (Hereafter, the amount of each chemical component is expressed in terms of mass %.)

In reality, however, the commercially pure titanium of JIS class 2 or 3 contains nitrogen at 0.015% at most and Fe at 0.1% at most, and thus it has literally been pure titanium except that oxygen at 0.07 to 0.3% and unavoidable impurities have been contained.

A sheet or a plate, a bar or a wire made of commercially pure titanium of JIS class 2 or 3 is used for producing products having various sectional shapes and dimensions and widely used in many fields, as stated above. Therefore, in order for a titanium material to be secondary-formed into a complicated shape by bending, cold forging or flat rolling (a bar or a wire having a round section is cold-rolled into the shape of a flat sheet or plate), a titanium material which can secure a higher ductility and a higher cold workability without the strength deteriorating has been strongly required.

In case of high strength titanium alloy, as a method of obtaining both high strength and high ductility, there is a method of adding both Fe and nitrogen at the same time as disclosed in Japanese Unexamined Patent Publication No. H8-833292 (International Publication No. WO96/33292). It is estimated that this method has a possibility of being applied to a titanium material with a strength level corresponding to JIS class 2 or 3 in which the strength is rather low. However, when the addition amount of Fe increases, in case of a titanium sheet or plate, the material anisotropy in a sheet or a plate plane becomes large, and, the problem here has been that, though the material shows an excellent strength and an excellent ductility in the longitudinal direction (L direction), it shows too high strength and thus low ductility in the directions perpendicular to the L direction. Furthermore, in case of a titanium bar or wire, the material anisotropy in a sectional plane becomes large, and, the problem here has been that, though the material shows an excellent strength and an excellent ductility in the longitudinal direction (L direction), it shows too high strength and thus low ductility in the directions perpendicular to the L direction, namely, in the circumferential and radial directions.

The material anisotropy stated above is mitigated by changing the rolling directions intermediately, namely by adopting a so-called cross rolling. However, the drawbacks are that the method cannot be applied to a lengthy material such as a strip of which a high productivity is required because of the dimensional restrictions of a rolling facility and that, even in case of a relatively short material such as a plate, the production cost increases. Besides, the aforementioned cross rolling cannot be applied to a bar or a wire.

In case of a wire having a very fine diameter, though there is no problem in terms of material properties as long as the property merely in the L direction is excellent, as, in general, the wire is subjected to various working not only in the L direction but also in the circumferential and radial directions during secondary working, it is required to sufficiently secure the workability in these directions too.

SUMMARY OF THE INVENTION

In view of the above situation, the present invention provides a sheet, a plate, a bar or a wire which is made of titanium and has a strength equal to, and a ductility higher than, those of a titanium material of JIS class 2 or 3 and, moreover, a low material anisotropy in a sheet or a plate plane of a sheet or a plate or in a sectional plane of a bar or a wire, and a method of producing the same.

The present inventors, as a result of studies of the relation between the chemical compositions and the properties of sheets, plates, bars or wires made of titanium having various components, found the relation between oxygen equivalent values and the properties and established the present invention by specifying the range of the oxygen equivalent values which fully satisfy all the properties. The gist of the present invention is as follows.

(1) A sheet, a plate, a bar or a wire which is made of titanium and has high ductility and low material anisotropy in a plate plane of a sheet or a plate, or in a sectional plane of a bar or a wire, characterized by: containing, in mass, Fe at 0.15 to 0.5%, nitrogen at 0.015 to 0.04% and oxygen, with the balance consisting of titanium and unavoidable impurities; and when the Fe content is defined as [Fe], the nitrogen content as [N] and the oxygen content as [O], oxygen equivalent value $Q=[O]+2.77[N]+0.1[Fe]$ being 0.11 to 0.28.

(2) A sheet or a plate, a bar or a wire which is made of titanium and has high ductility and low material anisotropy in a plate plane of a sheet or a plate, or in a sectional plane of a bar or a wire according to item (1), characterized by: the oxygen equivalent value Q being 0.11 to 0.17.

(3) A titanium sheet or plate having high ductility and low material anisotropy in a plate plane according to items (1) or (2), characterized in that the titanium sheet or plate is a hot-rolled or cold-rolled strip or a sheet, or plate cut out therefrom.

(4) A titanium bar or wire having high ductility and low material anisotropy in a sectional plane according to items (1) or (2), characterized in that the titanium bar or wire is a hot-rolled or cold-drawn coil, or a bar or wire cut out therefrom.

(5) A method of producing a sheet or plate, a bar or a wire which is made of titanium and has high ductility and low material anisotropy in a plate plane of a sheet or a plate, or in a sectional plane of a bar or a wire according to any one of items (1) to (4), characterized in that all or a part of the amounts of Fe and nitrogen contained therein are supplied by adding Fe containing nitrogen when the material is melted.

(6) A method of producing a sheet or a plate, a bar or a wire which is made of titanium and has high ductility and low material anisotropy in a plate plane of a sheet or a plate, or in a sectional plane of a bar or a wire according to the item (5), characterized in that Fe containing nitrogen is mainly composed of one or both of $Fe_3N$ and $Fe_4N$.

DESCRIPTION OF THE PREFERRED EMBODIMENT

The present inventors, as a result of studies of the relation between the chemical compositions and the properties of sheets, plates, bars or wires made of titanium having various components, found the following important phenomena.

① The material anisotropy in a plate plane of a sheet or a plate rolled in one direction increases when Fe is added in excess of 0.5 mass %, and the material anisotropy in case of adding Fe at 0.5 mass % or less is substantially the same as that in case of not adding Fe.

② The material anisotropy in a sectional plane of a bar or a wire subjected to working such as rolling or wire drawing increases when Fe is added in excess of 0.5 mass %, and the material anisotropy in case of adding Fe at 0.5 mass % or less is substantially the same as that in case of not adding Fe.

③ When the addition amount of Fe is 0.15 mass % or more, the addition of nitrogen at 0.04 mass % or less makes the strength high without lowering the ductility, or makes the ductility improve without deteriorating the strength.

The present invention is established based on the above three findings. Here, in case ③, when the addition amount of Fe exceeds 0.6 mass %, the effect disappears, but, when the addition amount of Fe exceeds 0.9 mass %, the relation between strength and ductility caused by the combined addition of Fe and nitrogen is improved as the amount of β phase which is excellent in the balance between strength and ductility increases.

However, though the effects show up in the case of a high strength alloy as disclosed in Japanese Unexamined Patent Publication No. H8-833292 (International Publication No. WO96/33292), the strength becomes excessive in the case of a titanium material having a strength of JIS class 2 or 3, which is the subject of the present invention, and, on the contrary, ductility and workability, which are required of a titanium material in the above-mentioned classes (categories), are impaired and thus the effects cannot be applied to a material which requires the strength level of the present invention.

The reason for specifying the contents of oxygen, nitrogen and Fe in the item (1) will be explained hereunder.

Item (1) specifies that Fe is added at 0.15 to 0.5 mass %. The reason why it specifies that Fe is added at 0.15 mass % or more is because Fe addition at 0.15 mass % or more is necessary for improving ductility without lowering strength or improving strength without deteriorating ductility by adding Fe in combination with nitrogen, as explained in the above finding ③. However, if Fe is added in excess of 0.5 mass %, the material anisotropy increases as described in the above findings ① and ②. Therefore, the upper limit of the addition amount of Fe is set at 0.5 mass %.

Further, the item (1) specifies that nitrogen is added at 0.015 to 0.04 mass %. The reason is explained hereunder. When the addition amount of nitrogen is less than 0.015 mass %, the improvement of the relation between strength and ductility caused by the combined addition of Fe and nitrogen is hardly recognized and it is impossible to improve ductility without lowering strength or to enhance strength without deteriorating ductility. Therefore, the addition amount of nitrogen is set at 0.015 mass % or more in item (1) of the present invention. On the other hand, when the addition amount of nitrogen exceeds 0.04 mass %, chemical compounds of Ti and nitrogen are generated and ductility deteriorates excessively, and then the effect of improving the relation between strength and ductility disappears. Therefore, the upper limit of the addition amount of nitrogen is set at 0.04 mass %.

Furthermore, item (1) specifies that the addition amount of oxygen is controlled so that oxygen equivalent value $Q=[O]+2.77[N]+0.1[Fe]$ may become 0.11 to 0.28. Here, [Fe], [N] and [O] represent the Fe content, the nitrogen content and the oxygen content, respectively, in terms of mass %. The oxygen equivalent value is an index integrally showing the ability of oxygen, nitrogen and Fe to strengthen a titanium material, and it means that, when the ability of oxygen of unit mass % is defined as 1, nitrogen of unit mass % has the strengthening ability 2.77 times that of oxygen and Fe of unit mass % has the strengthening ability 0.1 times that of oxygen.

The reason why the range of Q value is set at 0.11 to 0.28 in the present invention is because, by controlling the Q value within this range, a strength level equal to the strength of a titanium material of JIS class 2 or 3, which is the subject of the present invention, can be obtained. That is, when Q value is less than 0.11, the strength is too low and a material having a strength of JIS class 2, which is commercially available in the general market, cannot be obtained, and it is necessary to relatively lower the oxygen concentration in a titanium sheet, plate, bar or wire, thus expensive low oxygen titanium sponge has to be used, and therefore it is undesirable. On the other hand, when Q value exceeds 0.28, problems that strength increases excessively, ductility deteriorates relatively, and the material is hardly cold-worked, compared with a material of JIS class 3 which is commercially available in the general market, occur.

Next, item (2) specifies that the range of the oxygen equivalent value Q is 0.11 to 0.17. This is because, in a titanium sheet, plate, bar or wire according to item (1) of the present invention, a soft material which is often subjected to severe cold working requires higher ductility. That is, when a titanium sheet, plate, bar or wire having high ductility, according to item (1), has a Q value in the range of 0.11 to 0.17, which corresponds to a material having the strength level of JIS class 2, high ductility is further improved.

A titanium sheet, plate, bar or wire specified in the present invention substantially consists of Ti except oxygen, nitrogen, Fe and unavoidable impurities. The unavoidable impurities cited here mean Ni and Cr at less than 0.05 mass %, carbon at less than 0.015 mass %, hydrogen at 100 mass ppm or less, and the like.

With regard to the production method for a titanium sheet or plate, a sheet or a plate is produced with a plate rolling mill, a cold-rolling mill, or a continuous hot-rolling or cold-rolling mill which is used for a strip, and is subjected to a heat treatment such as annealing after the final rolling, and, if necessary, to descaling treatment such as polishing, shot blasting, salt treatment, pickling, and the like. Further, in some cases, a sheet or a plate is subjected to a very light cold working by skin-pass rolling, tension leveling or the like, in order to apply conditioning, adjust surface properties and improve flatness.

With regard to the production method for a titanium bar or wire, a bar or wire is produced with a bar hot-rolling mill for producing a straight bar, a hot-rolling mill for producing a bar or a wire for a coil, a cold-drawing machine, and the like, and is subjected to a heat treatment such as annealing after the final working, and, if necessary, to a descaling treatment such as polishing, shot blasting, salt treatment, pickling, and the like. Further, in some cases, a bar or wire is subjected to a very light cold working in order to apply conditioning and improve straightness and a sectional shape.

The above titanium sheet or plate, bar or wire is the same as that of JIS class 2 or 3 commonly used.

Item (3) specifies that the titanium sheet or plate is a hot-rolled or cold-rolled strip, or a sheet or plate cut out therefrom. The aforementioned items (1) and (2) are applicable to all the titanium sheets or plates produced through a rolling process, and the effects show up particularly when they are applied to products which undergo severe cold forming. The products are sheets or plates, and most of the sheets or thin plates are produced in the form of hot-rolled strips and cold-rolled strips and are used in the state of coiled strips, sheets and plates cut out therefrom in smaller sizes, or weld pipes wherein the sheets or plates are used by slitting the strips in the longitudinal direction.

The item (4) specifies that the bar or wire is a hot-rolled or cold-drawn coil or a bar or wire cut out therefrom. The aforementioned items (1) and (2) are applicable to all the titanium bars and wires produced through a wrought process, and the effects show up particularly when they are applied to products which undergo severe cold forming. The products are bars and wires with small sectional areas, and most of them are produced in the form of hot-rolled coils and cold-drawn coils and are used in the state of coils, bars and wires cut out therefrom in smaller length. As the effects of the present invention show up most in these products, it has been specified that the items (3) and (4) of the present invention are applied to these products.

Further, in the cases of items (1) to (4), when the addition amount of Fe is 0.3 mass % or less, the components according to the present invention are within the components specified in JIS class 2 or 3. However, as it is mentioned in the paragraph, Description of the Related Art, commercially pure titanium for industrial use classified in JIS class 2 or 3, which is actually commercially available, contains Fe at 0.1% at most and nitrogen at 0.015% at most.

Therefore, a titanium material having components specified in item (1) of the present invention cannot be produced by a method of producing conventional pure titanium, and Fe and nitrogen must be added by a certain method. In addition, when the Fe content exceeds 0.3 mass %, an obtained sheet, plate, bar or wire is made of low alloyed titanium which is not classified in JIS class 2 or 3. In this case too, the titanium material cannot be produced by a method of producing conventional pure titanium, and Fe and nitrogen must be added by a certain method.

As methods of adding Fe and nitrogen, there are a method of adding pure Fe and, as disclosed in Japanese Unexamined Patent Publication No. H7-331348 which discloses a method for adding TiN powder, Japanese Unexamined Patent Publication No. H7-331348 discloses that a method of using sponge titanium wherein the contents of Fe, oxygen and nitrogen are increased by a phenomena, such as accumulating at circumference of container during the production of sponge titanium, receiving components transferred from the melt or absorbing the components in the atmosphere.

The method of using Fe which contains nitrogen beforehand is a method most suitable for producing a product described in the items (1) to (4). That is, since substances hardly soluble at a high temperature such as TiN are not contained at all, there is no chance to generate insoluble inclusions causing the deterioration of ductility. Further, since the components of added elements are distinctly clarified, the accuracy of reaching the target values of components can be increased compared with the case of using sponge titanium formed over a wide area at the circumference of a large container during the production of sponge titanium, and components having sometimes uneven depending on the sites. The production method specified in the item (5) is a method wherein those advantages are utilized.

Even in the case of using Fe which contains nitrogen, it is possible to improve the accuracy of reaching the target values of components by using a raw material mainly composed of $Fe_3N$ and/or $Fe_4N$. This is because a titanium sheets, plate, bar or wire according to the items (1) to (4) of the present invention contains Fe at 0.15 to 0.5 mass % and nitrogen at 0.015 to 0.04 mass %, which are small amounts, and the use of a raw material mainly composed of nitriding iron consisting of $Fe_3N$ or $Fe_4N$, which chemical composition is most clearly known, is most suitable for reaching the target values of components in a titanium material.

Furthermore, when Fe containing nitrogen is used, even though it is oxidized, it can surely be used as a raw material. This is because the formed oxide is an oxide of Fe and the melting point is not so high as to remain insoluble during the melting of titanium and the oxygen in the oxide also constitutes a component of a titanium sheets, plate, bar or wire specified in the items (1) to (4).

EXAMPLE 1

(Test 1)

Titanium oxide ($TiO_2$), $Fe_3N$ and pure Fe were appropriately mixed into sponge titanium, 3.8 ton ingots having the compositions of the test numbers 1 to 23 in Table 1 were produced by melting twice in a vacuum arc remelting furnace, and then cold-rolled titanium strip sheets of 1 mm in thickness were produced through the processes of hot forging, strip hot-rolling, descaling treatment, strip cold-rolling and annealing.

Thereafter, JIS No. 5 tensile test pieces were cut out in the rolling direction (L direction) and in the direction perpendicular to the rolling direction (T direction), and tensile strength and elongation were measured by applying tensile tests. 10 test pieces per test number were subjected to the tensile tests and the average value of 10 test pieces per test number is shown in Table 1. In each of the tests, the scatter was small and both the tensile strength and elongation were within 1% of the average value.

In Table 1, each of the test numbers 5, 8, 9, 11, 13, 14, 17, 19 and 20, which are the examples according to the present invention, attains a tensile strength equal to, and an elongation of 1% or more higher than, in both the L and T directions, those of the conventional commercially pure titanium (comparative examples) which has an identical oxygen equivalent value but contains merely unavoidably included Fe and nitrogen existing in the raw material sponge titanium without adding Fe and nitrogen intentionally.

That is, the test number 5, compared with the test number 4, the test numbers 8, 9, and 11, compared with the test number 6, the test numbers 13 and 14, compared with the test number 12, the test number 17, compared with the test number 16, and the test numbers 19 and 20, compared with the test number 18, attain equal strength levels and elongations of 1% or more higher, respectively, and thus the effects of the present invention appear. In particular, the test numbers 5, 8, 9 and 11 attain extremely high elongations of 33% or more in the L direction and 38% or more in the T direction and the effects of the item (2) in the present invention appear.

Further, the test numbers 1 and 3 attain extremely high elongations in both the L and T directions and the difference between the tensile strength in the L direction and that in the T direction is also small. In particular, the test number 3 attains a tensile strength equal to, and an elongation of 1% or more higher than, in both the L and T directions, those of the conventional commercially pure titanium (test number 2) which has an identical oxygen equivalent value but contains merely unavoidably included Fe and nitrogen existing in the raw material sponge titanium without adding Fe and nitrogen intentionally.

However, the test numbers 1 and 3 attain a tensile strength level far lower than that of the test number 4, titanium material of JIS class 2 which is most commonly used, and the production cost of the test numbers 1 and 3 is high because a high purity raw material containing oxygen at 0.05 mass % or less is used as sponge titanium, and thus the effects of the present invention hardly appear. This is because the oxygen equivalent value Q is lower than 0.11, namely the lower limit specified in the present invention.

The test numbers 7 and 10 attain merely tensile strengths and elongations equal to those of the conventional pure titanium for industrial use (test number 6) which has an identical oxygen equivalent value but contains only unavoidably included Fe and nitrogen existing in the raw material sponge titanium without adding Fe and nitrogen intentionally, and thus the effects of the present invention hardly appear. This is because the addition amount of Fe in case of the test number 7 and the addition amount of nitrogen in case of the test number 10 are lower than the lower limit specified in the present invention.

The test number 15 shows a large difference of tensile strength between L and T directions, 80 MPa or more, and has a lower elongation in the L direction than that of the conventional commercially pure titanium (test number 12) which has an identical oxygen equivalent value but contains only unavoidably included Fe and nitrogen existing in the raw material sponge titanium without adding Fe and nitrogen intentionally, and thus the effects of the present invention are not obtained. This is because the addition amount of Fe exceeds the upper limit specified in the present invention and thus the material anisotropy in the plate plane increases.

The test number 21 has lower elongations in both the L and T directions than that of the conventional commercially pure titanium (test number 18) which has an identical oxygen equivalent value but contains only unavoidably included Fe and nitrogen existing in the raw material sponge titanium without adding Fe and nitrogen intentionally. This means that, as the addition amount of nitrogen exceeds the upper limit specified in the present invention, chemical compounds of Ti and nitrogen are generated, the ductility is impaired, and thus the effects of the present invention are not obtained.

Further, in Table 1, the test number 23 attains a tensile strength equal to and an elongation 1% or more higher than those of the conventional commercially pure titanium (test number 22) which has an identical oxygen equivalent value but contains only unavoidably included Fe and nitrogen existing in the raw material sponge titanium without adding Fe and nitrogen intentionally. However, the elongation is less than 25%, the tensile strength exceeds 600 MPa and, thus, the test number 23 is inferior in cold workability to a titanium material of JIS class 3 which is commercially available usually. Therefore, the effects of the present invention are not fully realized.

TABLE 1

| | Components (mass %) | | | | Tensile strength (MPa) | | Elongation (%) | | |
|---|---|---|---|---|---|---|---|---|---|
| Test number | Oxygen | Nitrogen | Fe | Oxygen equivalent value | L direction | T direction | L direction | T direction | Remarks |
| 1 | 0.0225 | 0.015 | 0.16 | 0.08 | 363 | 360 | 41.2 | 41.4 | Comparative example |
| 2 | 0.0812 | 0.005 | 0.05 | 0.10 | 382 | 380 | 35.8 | 39.2 | Comparative example |
| 3 | 0.0425 | 0.015 | 0.16 | 0.10 | 385 | 383 | 36.9 | 40.3 | Comparative example |
| 4 | 0.1012 | 0.005 | 0.05 | 0.12 | 480 | 440 | 33.5 | 39.0 | Comparative example |
| 5 | 0.0529 | 0.017 | 0.20 | 0.12 | 482 | 443 | 34.5 | 40.6 | Present invention 2, 3, 5 |

TABLE 1-continued

| Test number | Components (mass %) Oxygen | Nitrogen | Fe | Oxygen equivalent value | Tensile strength (MPa) L direction | T direction | Elongation (%) L direction | T direction | Remarks |
|---|---|---|---|---|---|---|---|---|---|
| 6 | 0.1412 | 0.005 | 0.05 | 0.16 | 505 | 461 | 32.2 | 36.3 | Comparative example |
| 7 | 0.0778 | 0.025 | 0.13 | 0.16 | 504 | 465 | 32.4 | 36.5 | Comparative example |
| 8 | 0.0738 | 0.025 | 0.17 | 0.16 | 505 | 462 | 33.6 | 38.0 | Present invention 2, 3, 5 |
| 9 | 0.0796 | 0.020 | 0.25 | 0.16 | 507 | 465 | 33.9 | 38.2 | Present invention 2, 3, 5 |
| 10 | 0.0990 | 0.013 | 0.25 | 0.16 | 504 | 466 | 32.7 | 36.6 | Comparative example |
| 11 | 0.0878 | 0.017 | 0.25 | 0.16 | 507 | 466 | 33.9 | 38.0 | Present invention 2, 3, 5 |
| 12 | 0.1612 | 0.005 | 0.05 | 0.18 | 527 | 490 | 31.5 | 34.7 | Comparative example |
| 13 | 0.0858 | 0.025 | 0.25 | 0.18 | 530 | 491 | 32.8 | 35.9 | Present invention 1, 3, 5 |
| 14 | 0.0851 | 0.018 | 0.45 | 0.18 | 531 | 492 | 32.8 | 35.8 | Present invention 1, 3, 5 |
| 15 | 0.0751 | 0.018 | 0.55 | 0.18 | 550 | 468 | 30.2 | 37.7 | Comparative example |
| 16 | 0.2012 | 0.005 | 0.05 | 0.22 | 550 | 505 | 29.6 | 32.5 | Comparative example |
| 17 | 0.1208 | 0.025 | 0.30 | 0.22 | 553 | 509 | 31.0 | 33.8 | Present invention 1, 3, 5 |
| 18 | 0.2412 | 0.005 | 0.05 | 0.26 | 581 | 543 | 26.8 | 30.3 | Comparative example |
| 19 | 0.1558 | 0.025 | 0.35 | 0.26 | 580 | 545 | 28.2 | 31.6 | Present invention 1, 3, 5 |
| 20 | 0.1225 | 0.037 | 0.35 | 0.26 | 582 | 545 | 28.4 | 31.9 | Present invention 1, 3, 5 |
| 21 | 0.1059 | 0.043 | 0.35 | 0.26 | 580 | 548 | 24.8 | 28.0 | Comparative example |
| 22 | 0.2812 | 0.005 | 0.05 | 0.30 | 606 | 570 | 23.4 | 27.6 | Comparative example |
| 23 | 0.1869 | 0.030 | 0.30 | 0.30 | 606 | 575 | 24.5 | 28.7 | Comparative example |

*Q = [O] + 2.77[N] + 0.1[Fe] ([O], [N] and [Fe] represent the contents (mass %) of oxygen, nitrogen and Fe, respectively.

(Test 2)

Titanium oxide ($TiO_2$), $Fe_3N$ and pure Fe were appropriately mixed into sponge titanium, 10.0 ton ingots having the compositions equal to those of the test numbers 6 and 9 in Table 1 were produced by melting twice in a vacuum arc remelting furnace, then several slabs were produced by hot forging, and, from those slabs, heavy plates of 10 mm in thickness, medium plates of 6 mm in thickness and hot-rolled strip coils of 4 mm in thickness were produced and then annealed. Then, some parts of the hot-rolled coils were cut and made into flat sheets through a tension leveler after descaling, and other parts thereof were rolled into cold-rolled strips of 0.8 mm in thickness, cut, subjected to skin-pass, and made into flat sheets.

Thereafter, round rod tensile test pieces of 12.5 mm in diameter and having the gauge length of 50 mm were cut out from the heavy plates and JIS No. 5 tensile test pieces were cut out from the other products in the rolling direction (L direction) and in the direction perpendicular to the rolling direction (T direction), and tensile strength and elongation were measured by applying tensile tests. 10 test pieces per test number were subjected to the tensile tests and the average value of 10 test pieces per test number is shown in Table 2. In each of the tests, the scatter was small and both the tensile strength and elongation were within ±1% of the average value.

As shown in Table 2, each of the test numbers 25, 27, 29, 31 and 33, which are the examples according to the present invention, attains a tensile strength equal to, and an elongation of 1% or more higher than, in both the L and T directions, those of the products having identical shapes made of the conventional commercially pure titanium (comparative examples) which has an identical oxygen equivalent value but contains only unavoidably included Fe and nitrogen existing in the raw material sponge titanium without adding Fe and nitrogen intentionally.

That is, the test number 25, compared with the test number 24, the test number 27, compared with the test number 26, the test number 29, compared with the test number 28, the test number 31, compared with the test number 30, and the test number 33, compared with the test number 32, attain equal strength levels and elongations of 1% or more higher, respectively, and thus the effects of the present invention appear. In particular, the test numbers 29, 31 and 33 are the sheets of which severe cold forming is required and it is possible to enjoy the effects of item (3) in the present invention sufficiently.

TABLE 2

| Test number | Product shape | Components | Tensile strength (MPa) L direction | Tensile strength (MPa) T direction | Elongation (%) L direction | Elongation (%) T direction | Remarks |
|---|---|---|---|---|---|---|---|
| 24 | 10 mm Heavy plate | The same as test number 6 (Q* = 0.16) | 510 | 480 | 35.2 | 37.0 | Comparative example |
| 25 | | The same as test number 9 (Q* = 0.16) | 509 | 482 | 36.4 | 38.1 | Present invention 2, 5 |
| 26 | 6 mm Medium plate | The same as test number 6 (Q* = 0.16) | 513 | 477 | 34.5 | 37.0 | Comparative example |
| 27 | | The same as test number 9 (Q* = 0.16) | 515 | 475 | 35.7 | 38.2 | Present invention 2, 5 |
| 28 | Hot-rolled strip 4 mm in thickness | The same as test number 6 (Q* = 0.16) | 501 | 458 | 32.0 | 36.8 | Comparative example |
| 29 | | The same as test number 9 (Q* = 0.16) | 504 | 460 | 33.5 | 38.3 | Present invention 2, 3, 5 |
| 30 | Sheet 4 mm in thickness cut out from hot- | The same as test number 6 (Q* = 0.16) | 509 | 463 | 31.0 | 35.6 | Comparative example |
| 31 | rolled strip | The same as test number 9 (Q* = 0.16) | 511 | 465 | 33.1 | 38.1 | Present invention 2, 3, 5 |
| 32 | Sheet 0.8 mm in thickness cut out from cold- | The same as test number 6 (Q* = 0.16) | 503 | 462 | 33.1 | 36.0 | Comparative example |
| 33 | rolled strip | The same as test number 9 (Q* = 0.16) | 507 | 467 | 34.2 | 38.0 | Present invention 2, 3, 5 |

*Q= [O] + 2.77[N] + 0.1[Fe] ([O], [N] and [Fe] represent the contents (mass %) of oxygen, nitrogen and Fe, respectively.)

(Test 3)

Raw materials for the addition of nitrogen shown in Table 3, in addition to titanium oxide ($TiO_2$) and pure Fe, were appropriately mixed into sponge titanium, 3.8 ton ingots which contained the components equal to those of the test number 19 in Table 1, namely to contain Fe of 0.350 mass %, nitrogen of 0.025 mass % and oxygen of 0.156 mass %, were produced by melting twice in a vacuum arc remelting furnace, and then cold-rolled titanium strip sheets of 1 mm in thickness were produced through the processes of hot forging, strip hot-rolling, descaling treatment, strip cold-rolling and annealing.

Thereafter, JIS No. 5 tensile test pieces were cut out in the direction perpendicular to the rolling direction (T direction), and elongation was measured by applying tensile tests. 20 test pieces per test number were subjected to the tensile tests and the average value of 20 test pieces per test number and the differences between the average value and the value most distant from the average value are shown in Table 3.

In Table 3, any of the test numbers attains the values of components almost equal to the target values. However, the test numbers 36 and 37 to which Fe powder containing nitrogen is added have values of components nearer to the target values than those of the test number 35 for which sponge titanium formed at the circumference of the container during the production of the sponge titanium is used, and thus the accuracy of hitting the target values of components is improved. That is, the effects of the method specified in the item (5) of the present invention show up. In particular, the test number 37 for which $Fe_4N$ powder is used has a high accuracy of hitting the target values of components and thus the effects of the method specified in the item (6) of the present invention show up.

Further, the test number 34 to which TiN powder is added has also a relatively high accuracy of reaching the target values of components, but the difference in elongation between the average value and the value most distant from the average in the T direction is 0.7% and that is larger than in the other cases, namely the scatter is large. This is because a small amount of TiN remains in an insoluble state and deteriorates the ductility.

TABLE 3

| Test number | Raw material used for adding nitrogen | Components (mass %) Fe | Components (mass %) Nitrogen | Components (mass %) Oxygen | Elongation in T direction: Average value (%) | Elongation in T direction: Maximum deviation from average value (%) | Remarks |
|---|---|---|---|---|---|---|---|
| 34 | TiN powder | 0.352 | 0.024 | 0.158 | 31.2 | 0.7 | Present invention 1, 3 |
| 35 | Sponge titanium formed at the | 0.332 | 0.029 | 0.154 | 31.9 | 0.3 | Present invention 1, 3 |

TABLE 3-continued

| Test number | Raw material used for adding nitrogen | Components (mass %) Fe | Nitrogen | Oxygen | Elongation in T direction Average value (%) | Maximum deviation from average value (%) | Remarks |
|---|---|---|---|---|---|---|---|
| | circumference of container during production of sponge titanium | | | | | | |
| 36 | Alloy powder composed of Fe and 4 mass % N | 0.355 | 0.022 | 0.157 | 31.6 | 0.3 | Present invention 1, 3, 4 |
| 37 | $Fe_4N$ powder | 0.352 | 0.024 | 0.158 | 31.7 | 0.3 | Present invention 1, 3, 5 |

Target components: Fe = 0.350 mass %, nitrogen = 0.025 mass % and oxygen = 0.156 mass %

EXAMPLE 2

(Test 4)

Titanium oxide ($TiO_2$), $Fe_3N$ and pure Fe were appropriately mixed into sponge titanium, 3.8 ton ingots having the compositions of the test numbers 41 to 63 in Table 4 were produced by melting twice in a vacuum arc remelting furnace, and then bar coils of 6 mm in diameter were produced through the processes of hot forging, hot-rolling to produce coils, descaling treatment, cold wire drawing and annealing.

Thereafter, tensile strength and elongation were measured by applying tensile tests. 10 test pieces per test number were subjected to the tensile tests and the average value of 10 test pieces per test number is shown in Table 4. In each of the tests, the scatter was small and both the tensile strength and elongation were within ±1% of the average value.

Further, in order to evaluate the material anisotropy in a sectional plane, Vickers hardness was measured at the portion on the sectional plane including the axis of a bar and parallel to the drawing direction and at the depth of the half of the radius from the surface (hereunder referred to as "L sectional plane"), the portion immediately under the surface, and the portion on the sectional plane perpendicular to the longitudinal direction (drawing direction) and at the depth of the half of the radius from the surface (hereunder referred to as "T sectional plane"). The Vickers hardness of the three portions represents the material property in the circumferential direction, in the radial direction and in the longitudinal direction (drawing direction), respectively. Here, the hardness was measured under the load of 1 kg and at 10 points on each portion. The average values are shown in Table 4. In each of the tests, the dispersion was small and the hardness was within ±2% of the average value.

In Table 4, each of the test numbers 45, 48, 49, 51, 53, 54, 57, 59 and 60, which are the examples according to the present invention, attains a tensile strength equal to, and an elongation of 1% or more higher, than those of the conventional commercially pure titanium (comparative examples) which has an identical oxygen equivalent value but contains merely unavoidably included Fe and nitrogen existing in the raw material sponge titanium without adding Fe and nitrogen intentionally.

That is, the test number 45, compared with the test number 44, the test numbers 48, 49 and 51, compared with the test number 46, the test numbers 53 and 54, compared with the test number 52, the test number 57, compared with the test number 56, and the test numbers 59 and 60, compared with the test number 58, attain equal strength levels and elongations of 1% or more higher, respectively, and thus the effects of the present invention appear. In particular, the test numbers 45, 48, 49 and 51 attain extremely high elongations of 35% or more and thus the effects of the item (2) in the present invention appear sufficiently.

Further, the test numbers 41 and 43 attain extremely high elongations and the difference in hardness among those sections is also small. In particular, the test number 43 attains a tensile strength equal to, and an elongation of 1% or more higher than, those of the conventional commercially pure titanium (test number 42) which has an identical oxygen equivalent value but contains merely unavoidably included Fe and nitrogen existing in the raw material sponge titanium without adding Fe and nitrogen intentionally.

However, the test numbers 41 and 43 attain a tensile strength level far lower than that of the test number 44, titanium material of JIS class 2 which is most commonly used, and the production cost of the test numbers 41 and 43 is high because a high purity raw material containing oxygen at 0.05 mass % or less is used as sponge titanium, and thus the effects of the present invention hardly appear. This is because the oxygen equivalent value Q is lower than 0.11, namely the lower limit specified in the present invention.

The test numbers 47 and 50 attain tensile strengths and elongations equal to those of the conventional commercially pure titanium (test number 46) which has an identical oxygen equivalent value but contains unavoidably included Fe and nitrogen existing in the raw material sponge titanium without adding Fe and nitrogen intentionally, and thus the effects of the present invention show up insufficiently. This is because the addition amount of Fe, in the case of the test number 47, and the addition amount of nitrogen, in case of the test number 50, are lower than the lower limit specified in the present invention.

The test number 55 has the hardness values varying by 9 to 10 (HV) depending on the measured planes and also has a lower elongation than that of the conventional commercially pure titanium (test number 52) which has an identical oxygen equivalent value but contains merely unavoidably included Fe and nitrogen existing in the raw material sponge titanium without adding Fe and nitrogen intentionally, and thus the effects of the present invention are not obtained. This is because the addition amount of Fe exceeds the upper limit specified in the present invention and thus the material anisotropy in the plate plane increases.

The test number 61 has a lower elongation than that of the conventional commercially pure titanium (test number 58) which has an identical oxygen equivalent value but contains merely unavoidably included Fe and nitrogen existing in the raw material sponge titanium without adding Fe and nitrogen intentionally. This means that, as the addition amount of nitrogen exceeds the upper limit specified in the present invention, the chemical compounds of Ti and nitrogen are generated, the ductility is impaired, and thus the effects of the present invention are not obtained.

Further, in Table 4, the test number 63 attains a tensile strength equal to, and an elongation 1% or more higher than, those of the conventional commercially pure titanium (test number 62) which has an identical oxygen equivalent value but contains merely unavoidably included Fe and nitrogen existing in the raw material sponge titanium without adding Fe and nitrogen intentionally. However, the elongation is less than 25%, the tensile strength exceeds 600 MPa, and thus the test number 63 is inferior in cold workability to a titanium material of JIS class 3 which is commercially available. Therefore, the effects of the present invention are not fully realized.

TABLE 4

| Test number | Components (mass %) Oxygen | Nitrogen | Fe | Oxygen equivalent value Q* | Tensile strength (MPa) | Elongation (%) | Vickers hardness (HV)** L sectional plane | Immediately under surface | T sectional plane | Remarks |
|---|---|---|---|---|---|---|---|---|---|---|
| 41 | 0.0225 | 0.015 | 0.16 | 0.08 | 366 | 43.3 | 119 | 120 | 118 | Comparative example |
| 42 | 0.0812 | −0.005 | 0.05 | 0.10 | 384 | 37.7 | 128 | 129 | 126 | Comparative example |
| 43 | 0.0425 | 0.015 | 0.16 | 0.10 | 388 | 39.0 | 128 | 127 | 125 | Comparative example |
| 44 | 0.1012 | −0.005 | 0.05 | 0.12 | 482 | 35.4 | 158 | 158 | 155 | Comparative example |
| 45 | 0.0529 | 0.017 | 0.20 | 0.12 | 485 | 36.6 | 162 | 161 | 159 | Present invention 2, 4, 6 |
| 46 | 0.1412 | 0.005 | 0.05 | 0.16 | 507 | 34.1 | 167 | 168 | 164 | Comparative example |
| 47 | 0.0778 | 0.025 | 0.13 | 0.16 | 507 | 34.4 | 166 | 167 | 164 | Comparative example |
| 48 | 0.0738 | 0.025 | 0.17 | 0.16 | 506 | 35.7 | 164 | 166 | 163 | Present invention 2, 4, 6 |
| 49 | 0.0796 | 0.020 | 0.25 | 0.16 | 510 | 35.9 | 168 | 167 | 167 | Present invention 2, 4, 6 |
| 50 | 0.0990 | 0.013 | 0.25 | 0.16 | 506 | 34.6 | 168 | 167 | 163 | Comparative example |
| 51 | 0.0879 | 0.017 | 0.25 | 0.16 | 510 | 36.0 | 170 | 169 | 167 | Present invention 2, 4, 6 |
| 52 | 0.1612 | 0.005 | 0.05 | 0.18 | 529 | 33.4 | 174 | 174 | 171 | Comparative example |
| 53 | 0.0858 | 0.025 | 0.25 | 0.18 | 533 | 34.9 | 175 | 173 | 172 | Present invention 1, 4, 6 |
| 54 | 0.0851 | 0.018 | 0.45 | 0.18 | 533 | 34.7 | 172 | 173 | 172 | Present invention 1, 4, 6 |
| 55 | 0.0751 | 0.018 | 0.55 | 0.18 | 553 | 32.2 | 190 | 191 | 181 | Comparative example |
| 56 | 0.2012 | 0.005 | 0.05 | 0.22 | 552 | 31.7 | 181 | 180 | 178 | Comparative example |
| 57 | 0.1208 | 0.025 | 0.30 | 0.22 | 556 | 32.9 | 182 | 182 | 179 | Present invention 1, 4, 6 |
| 58 | 0.2412 | 0.005 | 0.05 | 0.26 | 583 | 28.8 | 194 | 193 | 191 | Comparative example |
| 59 | 0.1558 | 0.025 | 0.35 | 0.26 | 583 | 30.3 | 190 | 191 | 188 | Present invention 1, 4, 6 |
| 60 | 0.1225 | 0.037 | 0.35 | 0.26 | 584 | 30.5 | 192 | 190 | 188 | Present invention 1, 4, 6 |
| 61 | 0.1059 | 0.043 | 0.35 | 0.26 | 583 | 26.8 | 190 | 192 | 188 | Comparative example |
| 62 | 0.2812 | 0.005 | 0.05 | 0.30 | 608 | 23.5 | 200 | 201 | 198 | Comparative example |
| 63 | 0.1869 | 0.030 | 0.30 | 0.30 | 609 | 24.9 | 201 | 201 | 198 | Comparative example |

*Q = [O] + 2.77[N] + 0.1[Fe] ([O], [N] and [Fe] represent the contents (mass %) of oxygen, nitrogen and Fe, respectively.)
**Plane for Vickers hardness measurement: L sectional plane means the portion on the sectional plane including the axis of a bar and being parallel to the drawing direction and at the depth of the half of the radius from the surface, and T sectional plane means the portion on the sectional plane perpendicular to the longitudinal direction (drawing direction) and at the depth of the half of the radius from the surface.

(Test 5)

Titanium oxide ($TiO_2$), $Fe_3N$ and pure Fe were appropriately mixed into sponge titanium, 10.0 ton ingots having the compositions equal to those of the test numbers 46 and 49 in Table 4 were produced by melting twice in a vacuum arc remelting furnace, then several billets were produced by hot forging, and, from those billets, straight bars of 30 mm in diameter, straight bars of 15 mm in diameter and hot-rolled coils of 10 mm in diameter were produced and then annealed. Then, some parts of the hot-rolled coils were cut and made into straight bars through tension straightening after descaling, and other parts thereof were formed into coils of 4 mm in diameter by cold wire drawing, cut, annealed, and then made into straight wires by tension straightening.

Thereafter, round rod tensile test pieces of 12.5 mm in diameter and having the gauge length of 50 mm were cut out from the bars of 30 mm and 15 mm in diameter and other tensile test pieces were prepared by using the other products themselves after subjected to descaling, and tensile strength and elongation were measured by applying tensile tests. 10 test pieces per test number were subjected to the tensile tests and the average value of 10 test pieces per test number is shown in Table 5. In each of the tests, the scatter was small and both the tensile strength and elongation were within ±1% of the average value. Further, in the same way as Test 3, Vickers hardness was measured under the load of 1 kg at the portions on an L sectional plane and a T sectional plane and immediately under the surface. In this case too, the hardness was measured at 10 points on each portion and the average values are shown in Table 5. The scatter was small and the hardness was within ±2% of the average value.

As shown in Table 5, each of the test numbers 65, 67, 69, 71 and 73, which are the examples according to the present invention, attains a tensile strength equal to, and an elongation of 1% or more higher than, those of the products having identical shapes made of the conventional commercially pure titanium (comparative examples) which has an identical oxygen equivalent value but contains merely unavoidably included Fe and nitrogen existing in the raw material sponge titanium without adding Fe and nitrogen intentionally.

That is, the test number 65, compared with the test number 64, the test number 67, compared with the test number 66, the test number 69, compared with the test number 68, the test number 71, compared with the test number 70, and the test number 73, compared with the test number 72, attain equal strength levels and elongations of 1% or more higher, respectively, and thus the effects of the present invention appear. In particular, the test numbers 69, 71 and 73 are the coiled products of which severe cold forming is frequently required and it is possible to enjoy the effects of item (4) in the present invention sufficiently.

TABLE 5

| Test number | Product shape | Components | Tensile strength (MPa) | Elongation (%) | Vickers hardness (HV) L sectional plane | Immediately under surface | T sectional plane | Remarks |
|---|---|---|---|---|---|---|---|---|
| 64 | Straight bar 30 mm in diameter | The same as test number 6 | 515 | 37.0 | 170 | 169 | 166 | Comparative example |
| 65 | | The same as test number 9 | 515 | 38.3 | 173 | 172 | 169 | Present invention 2, 6 |
| 66 | Straight bar 15 mm in diameter | The same as test number 6 | 517 | 36.6 | 171 | 170 | 167 | Comparative example |
| 67 | | The same as test number 9 | 519 | 37.8 | 172 | 173 | 170 | Present invention 2, 6 |
| 68 | Hot-rolled bar coil 10 mm in diameter | The same as test number 6 | 506 | 34.0 | 173 | 171 | 169 | Comparative example |
| 69 | | The same as test number 9 | 508 | 35.6 | 167 | 166 | 164 | Present invention 2, 4, 6 |
| 70 | Bar 10 mm in diameter cut out from hot-rolled coil | The same as test number 6 | 513 | 33.0 | 170 | 172 | 168 | Comparative example |
| 71 | | The same as test number 9 | 515 | 35.2 | 169 | 168 | 166 | Present invention 2, 4, 6 |
| 72 | Wire 4 mm in diameter cut out from cold-rolled coil | The same as test number 6 | 508 | 35.3 | 171 | 170 | 167 | Comparative example |
| 73 | | The same as test number 9 | 511 | 36.4 | 173 | 174 | 170 | Present invention 2, 4, 6 |

*Q = [O] + 2.77[N] + 0.1[Fe] ([O], [N] and [Fe] represent the contents (mass %) of oxygen, nitrogen and Fe, respectively.)
**Plane for Vickers hardness measurement: L sectional plane means the portion on the sectional plane including the axis of a bar and being parallel to the drawing direction and at the depth of the half of the radius from the surface, and T sectional plane means the portion on the sectional plane perpendicular to the longitudinal direction (drawing direction) and at the depth of the half of the radius from the surface.

(Test 6)

Raw materials for the addition of nitrogen shown in Table 6, in addition to titanium oxide ($TiO_2$) and pure Fe, were appropriately mixed into sponge titanium, 3.8 ton ingots which contained the components equal to those of the test number 59 in Table 4, namely to contain Fe at 0.350 mass %, nitrogen at 0.025 mass % and oxygen at 0.156 mass %, were produced by melting twice in a vacuum arc remelting furnace, and then wire coils of 4 mm in diameter were produced through the processes of hot forging, hot-rolling to produce coils, descaling treatment, cold wire drawing and annealing.

Thereafter, elongation was measured by applying tensile tests. 20 test pieces per test number were subjected to the tensile tests and the average value of 20 test pieces per test number and the difference between the average value and the value most distant from the average value are shown in Table 6.

In Table 6, any of the test numbers attains the values of components almost equal to the target values. However, the test numbers 76 and 77 to which Fe powder containing nitrogen is added have the values of components nearer to the target values than those of the test number 75 for which sponge titanium formed at the circumference of the container during the production of the sponge titanium is used, and thus the accuracy of reaching the target values of components is improved. That is, the effects of the method specified in the item (5) of the present invention appear. In particular, the test number 77, for which $Fe_4N$ powder is used, has a high accuracy of reaching the target values of components and thus the effects of the method specified in the item (6) of the present invention appear.

Further, the test number 74 to which TiN powder is added has also a relatively high accuracy of reaching the target values of components, but the difference in elongation between the average value and the value most distant from the average is 0.9% and the value is larger than the values, 0.2 to 0.4, in the other cases, namely the scatter is large. This is because a small amount of TiN remains in an insoluble state and deteriorates the ductility.

TABLE 6

| Test number | Raw material used for adding nitrogen | Components (mass %) Fe | Nitrogen | Oxygen | Elongation Average value (%) | Maximum deviation from average value (%) | Remarks |
|---|---|---|---|---|---|---|---|
| 74 | TiN powder | 0.352 | 0.024 | 0.158 | 33.3 | 0.9 | Present invention 1, 3 |
| 75 | Sponge titanium formed at the circumference of container during production of sponge titanium | 0.332 | 0.029 | 0.154 | 32.9 | 0.4 | Present invention 1, 3 |

TABLE 6-continued

| Test number | Raw material used for adding nitrogen | Components (mass %) Fe | Nitrogen | Oxygen | Elongation Average value (%) | Maximum deviation from average value (%) | Remarks |
|---|---|---|---|---|---|---|---|
| 76 | Alloy powder composed of Fe and 4 mass % N | 0.355 | 0.022 | 0.157 | 33.5 | 0.3 | Present invention 1, 3, 4 |
| 77 | $Fe_4N$ powder | 0.352 | 0.024 | 0.158 | 33.8 | 0.2 | Present invention 1, 3, 5 |

What is claimed is:

1. A sheet, a plate, a bar or a wire which is made of titanium and has high ductility and low material anisotropy in a plate plane of a sheet or a plate, or in a sectional plane of a bar or a wire, characterized by: containing, in mass, Fe at 0.15 to 0.5%, nitrogen at 0.015 to 0.04% and oxygen, with the balance consisting of titanium and unavoidable impurities; and when the Fe content is defined as [Fe], the nitrogen content as [N] and the oxygen content as [O], the oxygen equivalent value Q=[O]+2.77[N]+0.1[Fe] being 0.11 to 0.28.

2. A sheet, a plate, a bar or a wire which is made of titanium and has high ductility and low material anisotropy in a plate plane of a sheet or a plate, or in a sectional plane of a bar or a wire according to claim 1, characterized by: the oxygen equivalent value Q being 0.11 to 0.17.

3. A titanium sheet or plate having high ductility and low material anisotropy in a plate plane according to claim 1 or 2, characterized in that the titanium sheet or plate is a hot-rolled or cold-rolled strip, or a sheet or a plate cut out therefrom.

4. A titanium bar or wire having high ductility and low material anisotropy in a sectional plane according to claim 1 or 2, characterized in that the titanium bar or wire is a hot-rolled or cold-drawn coil or a bar or wire cut out therefrom.

* * * * *